US005454474A

United States Patent [19]

James

[11] Patent Number: 5,454,474

[45] Date of Patent: Oct. 3, 1995

[54] DUAL WEIGHT ASSEMBLY FOR A CRANE

[75] Inventor: Steven L. James, Muskego, Wis.

[73] Assignee: Harnischfeger Corporation, Brookfield, Wis.

[21] Appl. No.: 296,440

[22] Filed: Oct. 13, 1994

[51] Int. Cl.[6] ..... B66C 13/18

[52] U.S. Cl. ..... 212/281; 254/269

[58] Field of Search ..... 212/132, 152; 254/269

[56] References Cited

U.S. PATENT DOCUMENTS

| | | | |
|---|---|---|---|
| 761,884 | 6/1904 | Harding . | |
| 1,369,147 | 2/1921 | Valls | 254/269 |
| 3,233,746 | 2/1966 | Fawell | 212/86 |
| 3,834,551 | 9/1974 | Nanowsky | 212/39 |
| 4,535,899 | 8/1985 | Bergeron | 212/152 |

FOREIGN PATENT DOCUMENTS

| | | | |
|---|---|---|---|
| 594018 | 2/1978 | U.S.S.R. | 212/152 |
| 597623 | 3/1978 | U.S.S.R. | 212/152 |

OTHER PUBLICATIONS

Harnischfeger Bulletin ED-8—Limit Switches—Types DB135, DB270 and DB540.

Harnischfeger Bulletin 592—Type HB Control Circuit Limit Switch for Hoist Motion.

Harnischfeger Bulletin 592—DB90 Power Limit Switch for Hoist Motion.

Harnischfeger Bulletin 592—Limit Switches for Hoist Motion.

*Primary Examiner*—Michael S. Huppert
*Assistant Examiner*—Thomas J. Brahan
*Attorney, Agent, or Firm*—Jansson & Shupe, Ltd.

[57] ABSTRACT

The disclosure involves a material handling machine, e.g., a crane, having a control circuit switch and a power limit switch. Disclosed is a new weight assembly having first and second weights. The control switch is maintained at a position by the first weight and the power switch is maintained at a position by the second weight which is positioned above the first weight. The weights are telescoped to one another so that vertical weight alignment is assured as the crane hoist bottom block contacts and lifts the first weight. If the bottom block continues its upward travel past a maximum desired elevation, the first weight (urged by the bottom block) lifts the second weight, permitting the power limit switch to trip and preventing the bottom block from continuing upward. And the new assembly is ideal where the space available for limit switch weights is restricted.

20 Claims, 6 Drawing Sheets

DUAL WEIGHT ASSEMBLY FOR A CRANE

FIELD OF THE INVENTION

This invention is related to material-handling machines and, more particularly, to overhead load-hoisting cranes.

BACKGROUND OF THE INVENTION

Material handling machines are available in a wide variety of configurations to suit particular applications. Such machines include fork-type lift trucks, front end loaders and many others.

Another type of material handling machine (and the one to which the invention relates), is known as an overhead travelling crane. In a common configuration, such cranes include a pair of bridge girders spanning rather widely spaced railroad type bridge rails. Such rails are suspended above, for example, a factory floor or an outdoor steel handling yard. The girders are supported and propelled by flanged wheels riding atop the rails.

Mounted atop each girder and extending along its length is a trolley rail, atop which is mounted a trolley capable of "traversing" movement, i.e., movement along a line generally normal to the line of movement of the entire crane. The trolley is equipped with at least one hoist drive and a load-hoisting hook (or other load-handling device) attached below a bottom block for moving loads from place to place. So configured, the crane is capable of lifting a load from any location on a factory floor, for example, and moving it to any other location.

A factor considered by designers of overhead travelling cranes is the possibility of the bottom block being raised to an elevation at which it strikes the solid undercarriage of the trolley or even "wraps" on the hoist drum. In either event, there is a substantial risk of breaking the stranded rope-like steel cables by which the bottom block is attached to the rotating hoist drum. If a cable breaks, there is a chance that the load will be uncontrollably dropped.

To help guard against that eventuality, crane designers have employed a control circuit limit switch and a power circuit limit switch actuated in one of the ways described below. If the bottom block reaches a certain elevation, the control limit switch is tripped. Such limit switch tripping disables the control circuit or, in the alternative, "reconfigures" the control circuit in such a way that the hoist drive controller causes the rate of bottom block ascent to slow markedly.

If the operator fails to stop the hoist drive or if the control limit switch malfunctions for some reason, the bottom block continues its upward movement and trips the power limit switch. This opens the "raise" power connections to the hoist drive motor and stops bottom block movement before such block strikes the trolley undercarriage or otherwise reaches an abnormal position.

One type of control limit switch has a lever-like counterweight assembly attached to the switch shaft. Such assembly is biased to an operating position by a weight suspended from the assembly by a cable. When tension on such cable is relieved by inadvertently hoisting the bottom block until it lifts the suspended weight, the counterweight "trips" the switch.

Similarly, the power circuit limit switch has a heavy block-shaped weight suspended from one end of a limit switch arm, the other end of which has a counterweight. The torque produced by the suspended weight is greater than that produced by the counterweight and the suspended weight retains the power switch in the operative position. On the other hand, when the suspended weight is lifted by the ascending bottom block, the counterweight "takes over" and trips the power switch.

While these arrangements have been generally satisfactory, they are less than completely so in certain situations. For example, if both the power limit switch and the control limit switch are of the suspended-weight type, the weights should be generously spaced apart laterally so as to avoid interfering with one another. And a cramped installation may not afford the luxury of such lateral spacing.

Yet another characteristic of known arrangements is that they lack easy-to-use means for adjustment of the elevation at which one weight is suspended relative to the other. Another characteristic is that in general they are limited to applications involving a single control switch.

A dual weight assembly which addresses the aforementioned characteristics of known arrangements would be an important advance in the art.

OBJECTS OF THE INVENTION

It is an object of the invention to provide an improved crane dual weight assembly overcoming some of the problems and shortcomings of the prior art.

Another object of the invention is to provide an improved crane dual weight assembly having two weights which interact with one another.

Another object of the invention is to provide an improved crane dual weight assembly which is particularly useful in installations where the size of the spatial region available for switch weights is restricted.

Still another object of the invention is to provide an improved crane dual weight assembly which readily adapts to crane hoist drives having both control and power circuit limit switches.

Another object of the invention is to provide an improved crane dual weight assembly incorporating certain adjustment features aiding installation.

Another object of the invention is to provide an improved crane dual weight assembly useful in installations where plural control switches are desired or required. How these and other objects are accomplished will become apparent from the following detailed description and from the drawing.

SUMMARY OF THE INVENTION

The invention relates to the matter of controlling crane hoist "bottom block" travel using two limit switches. Such invention is particularly suitable for a material handling machine of the type having a first or control circuit switch maintained at a position by a first weight. A second switch such as a power limit switch is maintained at a position by a second weight. In the invention, the first weight and the second weight are telescoped to one another so that alignment of the weights is assured and so that the two-switch, two-weight approach can be used, notwithstanding that the size of the spatial region available for switch weights is relatively small.

In a more specific aspect of the invention, the first weight, the lower of the two weights and that first contacted by a crane hoist bottom block during its upward travel, includes a bar-like member. The second weight includes an aperture and the bar-like member extends through such aperture. In a highly preferred embodiment, the second weight has two apertures and the first weight has two bar-like members, one extending telescope-fashion through each aperture.

The bar-like members are generally parallel to one another and joined rigidly together by a cross-piece which extends between such members. The second weight also has a cross-piece extending between and rigidly joining two block-like portions. The first and second weights are suspended in such a way that the respective cross-pieces of such weights are generally vertically aligned with one another and with the bottom block.

Thus, when the crane hoist bottom block rises to a certain point, it contacts the cross-piece of the first weight and lifts such weight. If the bottom block continues its upward travel past a maximum desired elevation, the first weight (urged by the bottom block) lifts the second weight. The power limit switch is thereby tripped, the hoist motor is disabled in the upward direction and the bottom block is prevented from continuing upward.

In another aspect of the invention, the first weight is mounted for movement between a repose position, when the bottom block is below and away from such first weight, and a position which actuates the first switch. A collar-like stop device is mounted on each of the bar-like members of the first weight, such stop devices being above the respective block-like portions of the second weight. In the repose position, at least one of such stop devices is spaced from the second weight.

The first weight also has an abutment device mounted on each of the bar-like members below the respective block-like portions of the second weight. When the first weight is in the position actuating the first switch, the abutment devices are spaced from the second weight. However, if actuation of the first switch does not cause upward travel of the bottom block to stop (whether by opening a control circuit, sounding an alarm or otherwise), the abutment devices contact the second weight, eventually tripping the power limit switch.

It will be recalled that a crane hoist hook and its bottom block are suspended from the rotating hoist drum by cables. Since such cables are flexible, there can be instances (a load is lifted "off center," for example) when the bottom block swings from side to side or tends to do so. Therefore, in a preferred embodiment, the second weight includes an "eye-like" cable guide through which a non-running or "dead" cable extends.

In one preferred embodiment of the invention, each of the bar-like members extends through an elongate, vertical, cylindrical hole formed in one of the block-like portions of the second weight. However, that is not the only way the invention can be structured. In another preferred embodiment, a pipe-like tube member is attached to each block-like portion as by welding and each of the bar-like members extends through a respective tube member.

And the new assembly can be considered in another way. When the first weight is lifted by the bottom block as such block travels upward, the first weight contacts the second weight at two spaced-apart locations. Thus, the second weight is lifted by upward travel of the bottom block and the first weight. In a preferred configuration, each of the weights has a generally horizontally elongate portion and such portions are generally parallel to one another.

Further details of the invention are set forth in the following description and in the drawing.

DETAILED DESCRIPTION OF PREFERRED EMBODIMENTS

Figure 1:
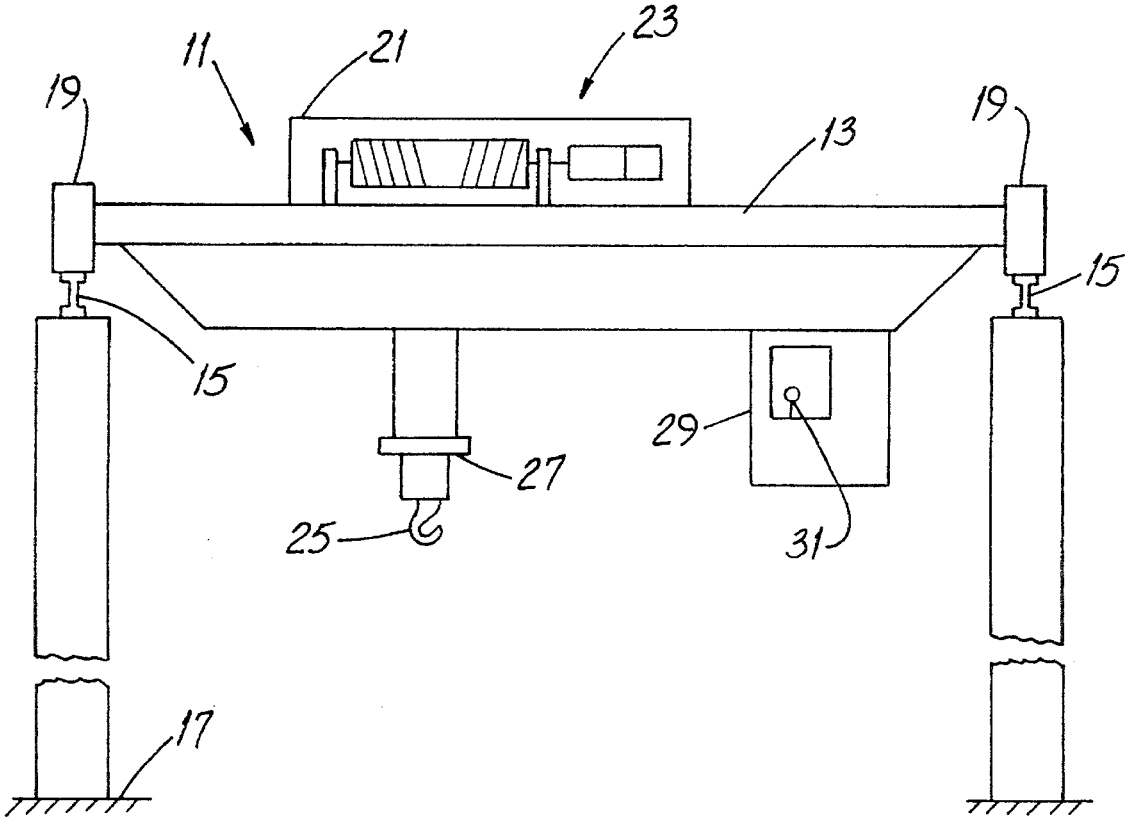
FIG. 1 is a side elevation view of a representative overhead travelling crane.
Figure 2:
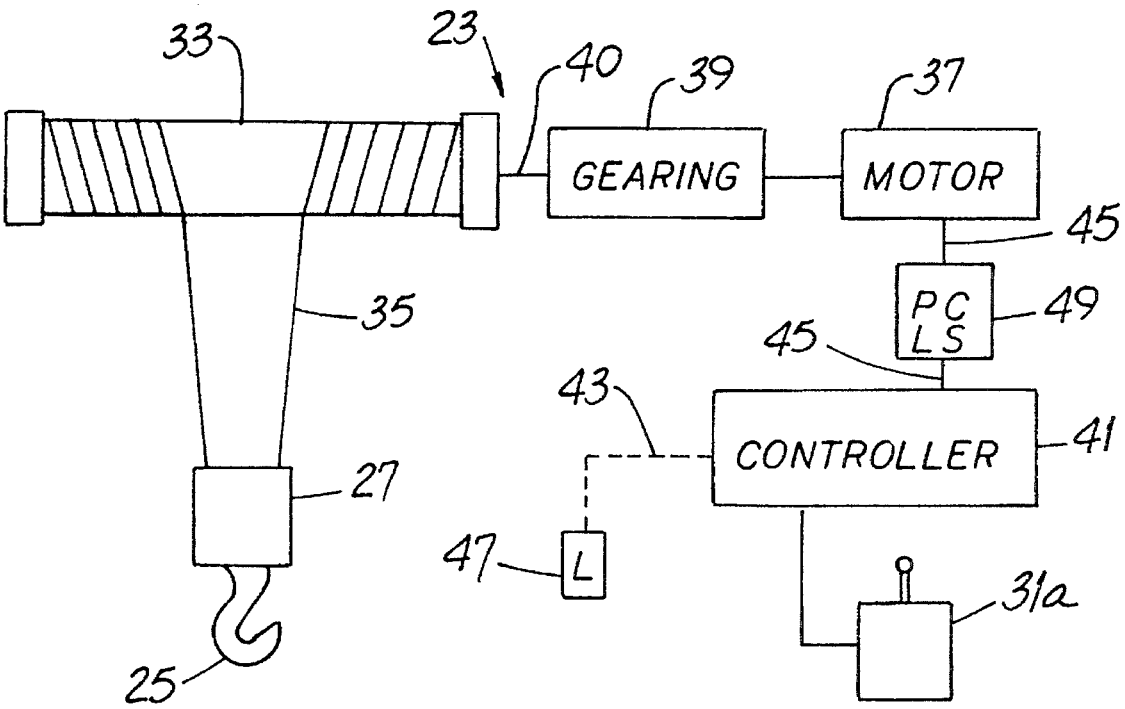
FIG. 2 is a simplified diagram of a hoist drive and a hoist drum for a crane like that shown in FIG. 1.

Before describing details of the inventive assembly 10, it will be helpful to have an understanding of the general arrangement of an overhead load-hoisting crane 11 and of typical power and control circuit limit switches used on such a crane 11. Referring to FIGS. 1 and 2, the exemplary overhead travelling crane 11 includes bridge girders 13 spanning rather widely spaced railroad type bridge rails 15. Such rails 15 are suspended above, for example, a factory floor 17. The crane bridge girders 13 are supported and propelled by flanged wheels 19 riding atop the rails 15. When the bridge drive is operated, the crane 11 moves along the rails 15, i.e., into and out of the drawing sheet as viewed in FIG. 1.

Mounted atop the girders 13 is a trolley 21 capable of "traversing" movement along a line generally normal to the line of movement of the entire crane 11, i.e., left and right as seen in FIG. 1. The trolley 21 is equipped with at least one hoist drive 23 and a load-hoisting hook 25 (or other load-handling device) attached to a bottom block 27 for moving loads from place to place.

Crane movement (including movement of the hoist, bridge and trolley functions) is under the control of an operator working in the crane cab 29. The operator manipulates master switches 31 to control direction and speed of each crane function. And other ways to control the crane 11, e.g., remote radio control, are possible.

FIG. 2 shows a representative hoist drive 23 including a rotating hoist drum 33 from which a bottom block 27 is suspended by cable 35. The drum 33 is driven by an electric motor 37 coupled to the drum shaft 40 through gearing 39 and the motor 37 is controlled (in both speed and direction of rotation) by an electrical controller panel 41 responsive to the hoist master switch 31*a*.

Figure 3:
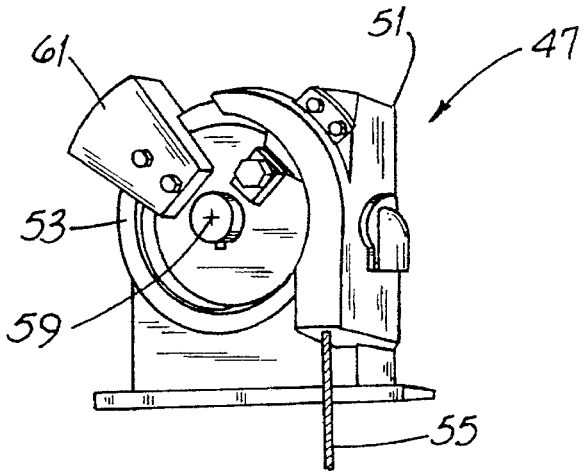
FIG. 3 is a perspective view of a control limit switch and a cable for attachment to a weight. The cable is broken away.
Figure 4:
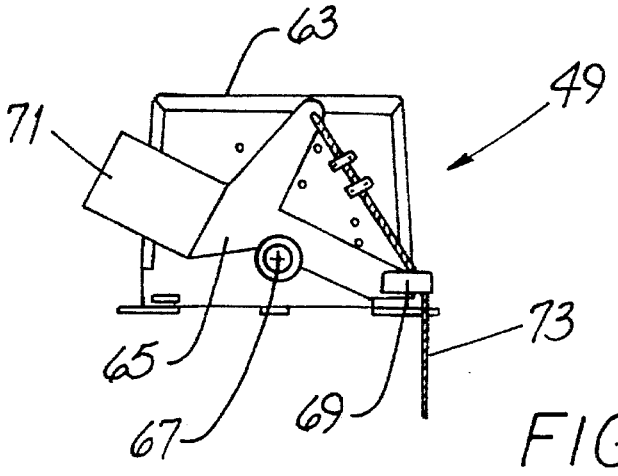
FIG. 4 is a side elevation view of a power circuit limit switch and a cable for attachment to a weight. The cable is broken away.
Figure 5:
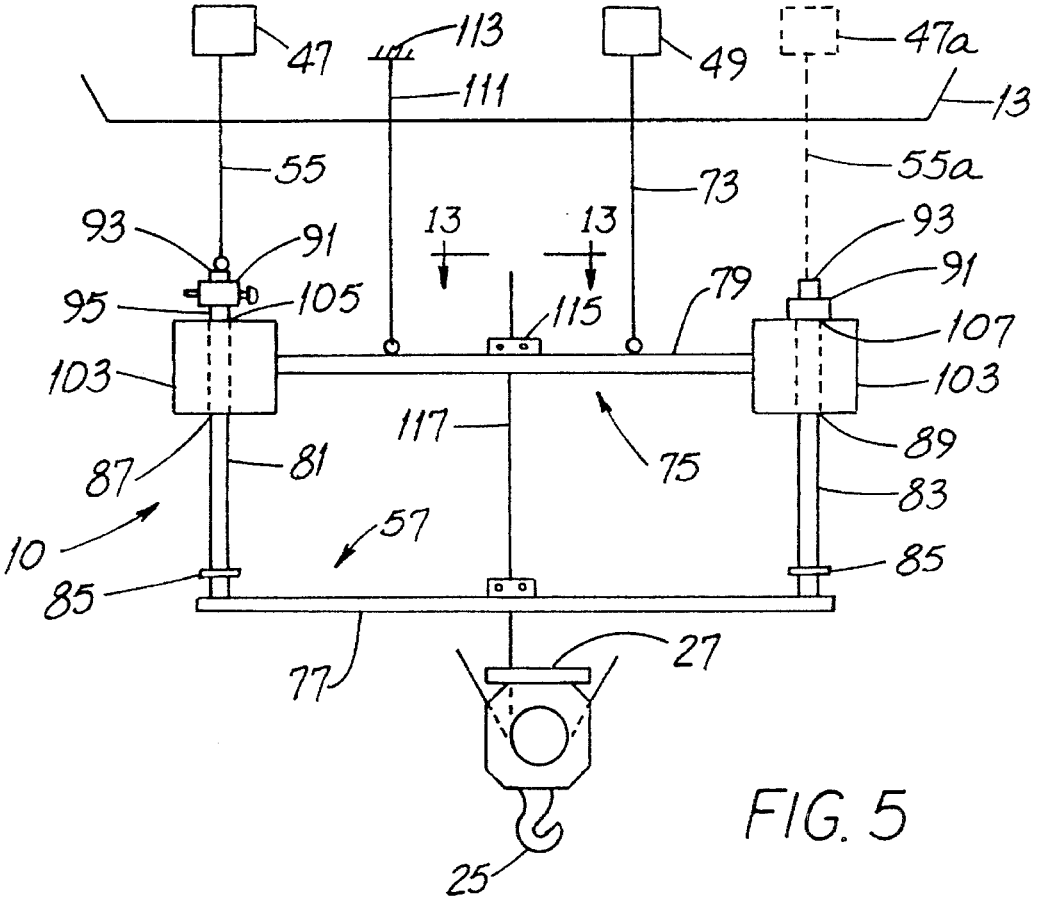
FIG. 5 is a side elevation view of one embodiment of the inventive dual weight assembly shown in conjunction with control and power circuit switches and in conjunction with a representation of the crane of FIG. 1. Certain surfaces and parts are shown in dashed outline and other parts are broken away.

Referring also to FIGS. 3, 4 and 5, before describing the limit switches 47, 49, it will be helpful to recall that an overhead crane 11 is usually equipped with a control circuit limit switch 47 (identified as "L" in FIG. 2) and a power circuit limit switch 49 (identified as "PCLS" in FIG. 2. Such switches 47, 49 are redundant in that the power circuit switch 49 trips if the control switch 47 does not function.

Typically, a control circuit limit switch 47 has its contacts connected to the motor controller 41 and the controller circuitry used to open and close contactors, relays and the like. On the other hand, a power circuit limit switch 49 is connected directly in the power leads 45 to the motor 37. Therefore, a power circuit limit switch 49 does not rely upon proper functioning of intervening relays, contactors and the like; such switch 49 disables the motor 37 directly. (Conventionally, a power circuit limit switch 49 is configured and connected so that if tripped, it prevents further upward-direction rotation of the motor 37 but permits downward-direction rotation.)

The control circuit limit switch 47 of FIG. 3 has a cabinet 51 containing electrical contacts connected in the motor controller 41 as represented by the line 43. The switch 47 has a pulley-like sheave 53 from which a rope-like cable 55 extends to attach to a suspended first weight 57. The sheave 53 pivots about the axis 59 of the switch shaft and has a counterweight 61.

When the cable 55 at least partially supports the weight 57, the sheave 53 is in the illustrated position. If the bottom block 27 is raised to an elevation at which the weight 57 is lifted sufficiently, the counterweight 61 causes counterclockwise rotation of the sheave 53 as such rotation is viewed in FIG. 3. The switch contacts are thereby opened to either prevent the motor 37 from being electrically powered in the hoisting direction or to slow the rotational speed of the motor 37. Whether the switch 47 stops or slows the motor 37 is a function of how the switch contacts are wired into the circuitry of the controller 41 in a known manner.

The power circuit limit switch 49 of FIG. 4 has a cabinet 63 containing electrical contacts connected in the motor power lead 45. The switch 49 is equipped with an arm 65 which pivots about the axis 67 of the switch shaft and which has a cable end 69 and a counterweight 71. A rope-like cable 73 extends between the end 69 and the second weight 75 and when such cable 73 at least partially supports the second weight 75, the arm is in the illustrated position.

However, if the bottom block 27 is raised to an elevation at which the weight 57 contacts and lifts the weight 75 some relatively small amount, the counterweight 71 causes counterclockwise (as shown in FIG. 4) rotation of the arm 65. The contacts are thereby opened, disconnecting the motor 37 from electrical power.

Referring particularly to FIG. 5, details of the new dual weight assembly 10 will now be set forth. Such assembly includes first and second weights 57 and 75, respectively, and both weights 57, 75 have elongate cross-pieces or portions 77, 79, respectively, which are generally horizontal and generally parallel to one another.

The first weight 57 has vertical first and second bar-like members 81 and 83, respectively. The portion 77 is preferably rigidly attached to the members 81, 83 such as by welding or bolting.

Each of the members 81, 83 has a collar-like abutment device 85 attached between the portion 77 and the second weight 75, preferably at a location slightly above such portion 77 and below the second weight 75. If the bottom block 27 lifts the first weight 57 sufficiently far, the abutment devices 85 contact the second weight 75 at two spaced apart locations 87, 89 and lift the second weight 75.

Each of the members 81, 83 also has a stop device 91 mounted thereon near the member upper end. When the weights 57, 75 are in the normal or "repose" position (as is the case when the bottom block 27 is spaced below the first weight 57), at least one stop device 91 is spaced slightly from the second weight 75 as indicated by numeral 95 in FIG. 5. This arrangement permits the weight 57 to be supported mostly by the control switch cable 55 rather than partly by the cable 55 and partly by the second weight 75.

In an alternate embodiment, another control switch 47*a* is attached to the upper end 93 of the second member 83 by a cable 55*a*. Such control switch 47*a* could be used to actuate visual and/or audible alarms, cause a log entry relating to operator proficiency or for some other purpose. If a second control switch 47*a* is used, the stop device 91 on the member 83 is similarly positioned to be spaced slightly above the second weight 75 rather than contacting such weight 75.

Figure 6:
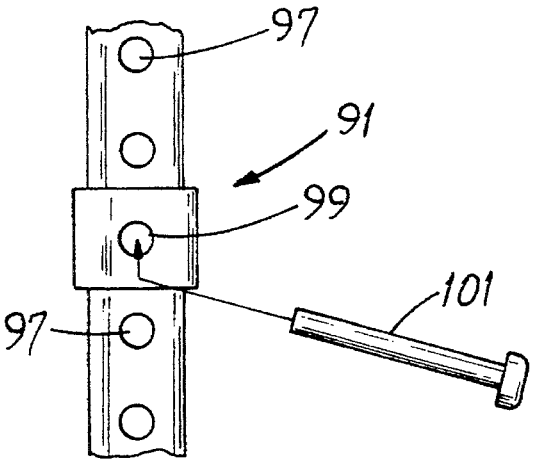
FIG. 6 is an elevation view showing a vertical member and a position-adjustable stop device that forms a part of a preferred embodiment of the invention. Parts are broken away.

A preferred means for adjusting the location of a stop device 91 is shown in FIG. 6 and includes a plurality of spaced holes 97 in a member 81, 83, a hole 99 in the stop device 91 and a bolt 101, cotter pin or the like for inserting through the hole 99 and one of the holes 97, 99. When the bolt 101 is removed, the device 91 can be moved to a position so that its hole 99 is in registry with an appropriate hole 97 in the member.

Referring further to FIG. 5, the second weight 75 includes a pair of spaced block-like portions 103 rigidly joined together by a portion 79. So configured, the second weight 75 generally resembles a weight lifter's bar bell.

In one preferred embodiment, each portion 103 has an aperture 105, 107 extending therethrough. Each aperture 105, 107 receives telescope-fashion a separate member 81, 83, respectively. The cross-sectional size and shape of an aperture 105, 107 and the corresponding member 81, 83 received through such aperture 105, 107, respectively, are cooperatively selected so that there is slight clearance between the member 81 or 83 and its aperture 105 or 107. So configured, the member 81, 83 is free to move with respect to the block-like portion 103.

Figure 7:
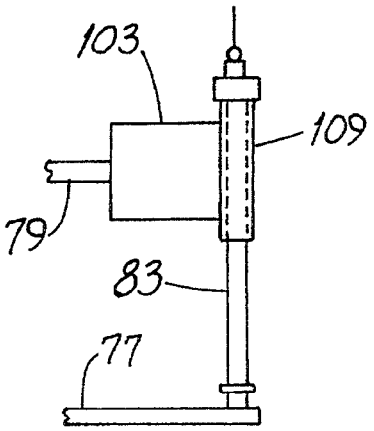
FIG. 7 is a side elevation view of another embodiment of the dual weight assembly. Parts are broken away.

In another preferred embodiment shown in FIG. 7, the portions 103 are free of interiorly-formed apertures 105, 107. Rather, each such portion 103 includes a pipe-like tube member 109 attached thereto and a bar-like member 81, 83 of the first weight 57 extends through a respective tube member 109.

Figure 8:
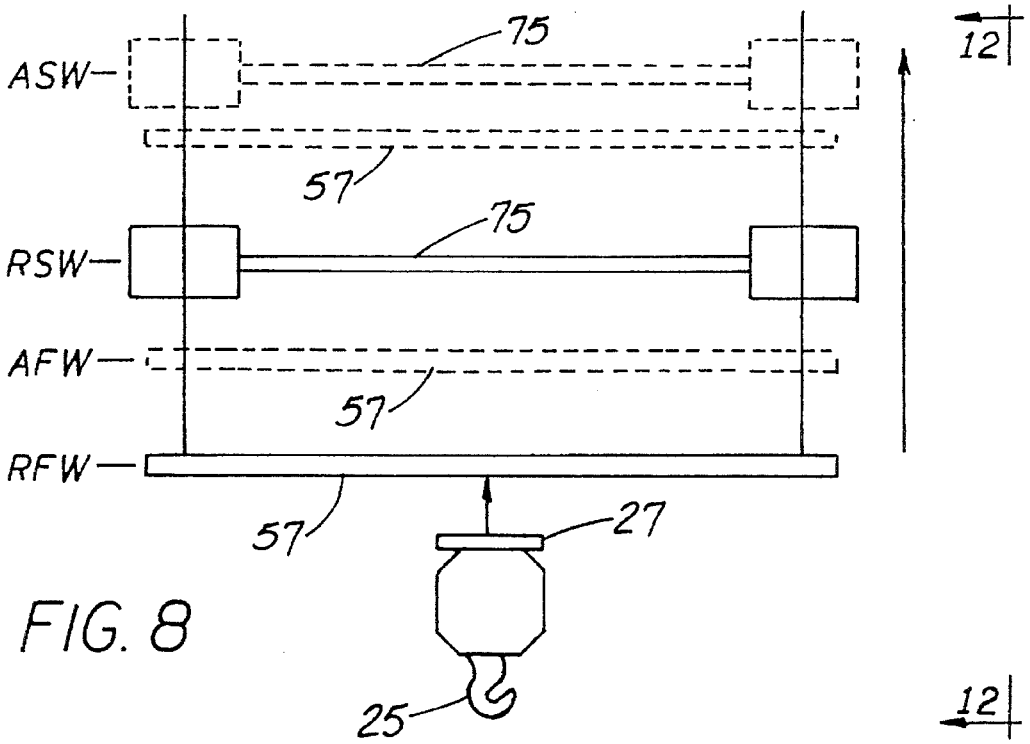
FIG. 8 is a side elevation view showing, in solid outline, the repose positions of the assembly first and second weights and also showing other positions of such weights in dashed outline.

Referring now to FIG. 8, certain positional relationships of the weights 57, 75 will now be described. When the weights 57, 75 are in the repose position (as described above), they are at the positions RFW and RSW, respectively. As the crane bottom block 27 comes into contact with and lifts the first weight 57, such weight 57 will be lifted to a position AFW at which the control switch 47 is actuated. With such actuation, the hoist drive 23 is stopped, slowed or some kind of alarm is energized and in the latter instances it is assumed the operator stops the hoist drive 25 before the first weight 57 contacts the second weight 75.

However, if such stoppage does not occur, the first weight 57 continues to be lifted and contacts the second weight 75 at two spaced-apart locations 87, 89. Thereafter, both weights 57, 75 are lifted in unison until they reach the position ASW whereupon the power limit switch 49 is tripped, stopping the hoist drive 23.

Figure 9:
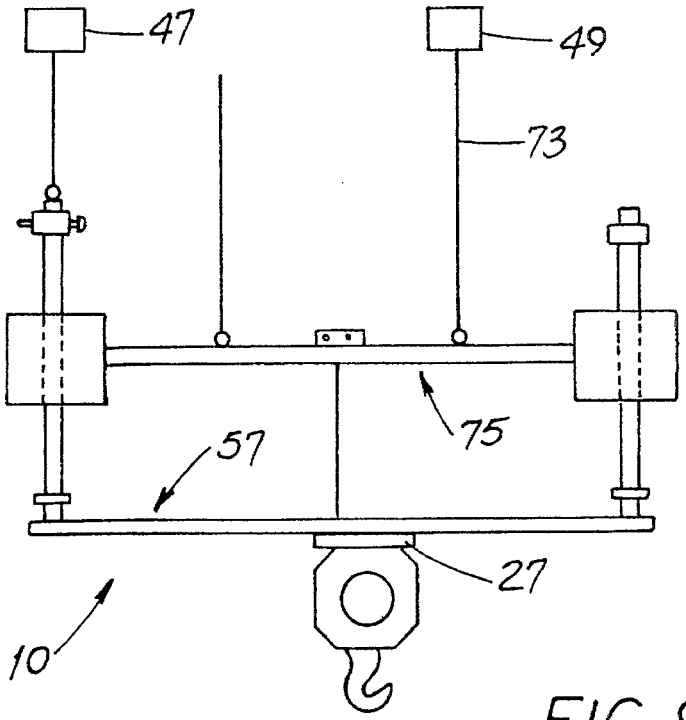
FIGS. 9, 10 and 11 comprise a sequence of view showing the relative positions of the two weights as the hoist bottom block moves upward.
Figure 10:
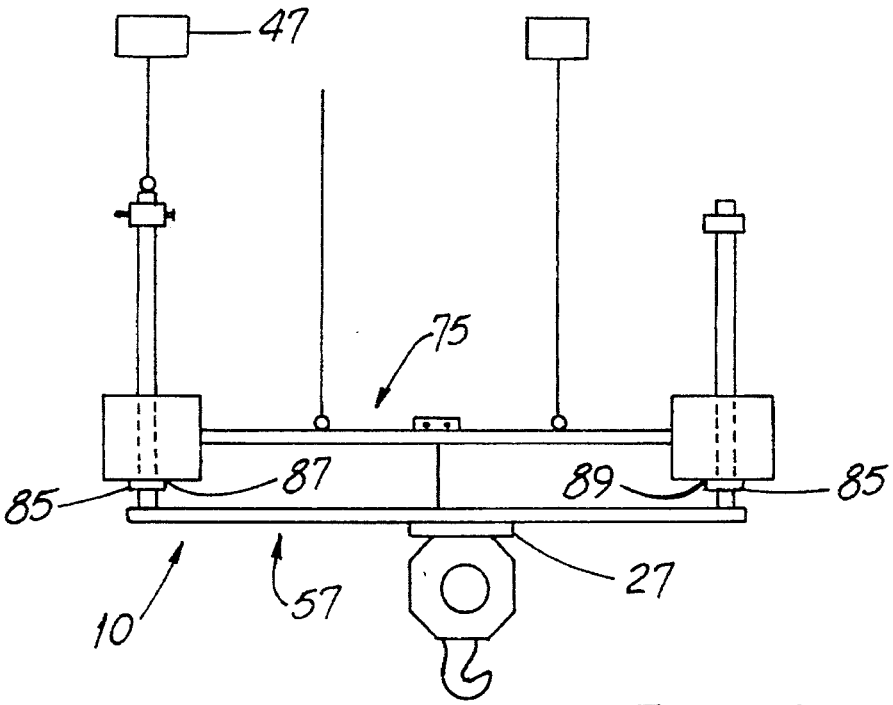
Figure 11:
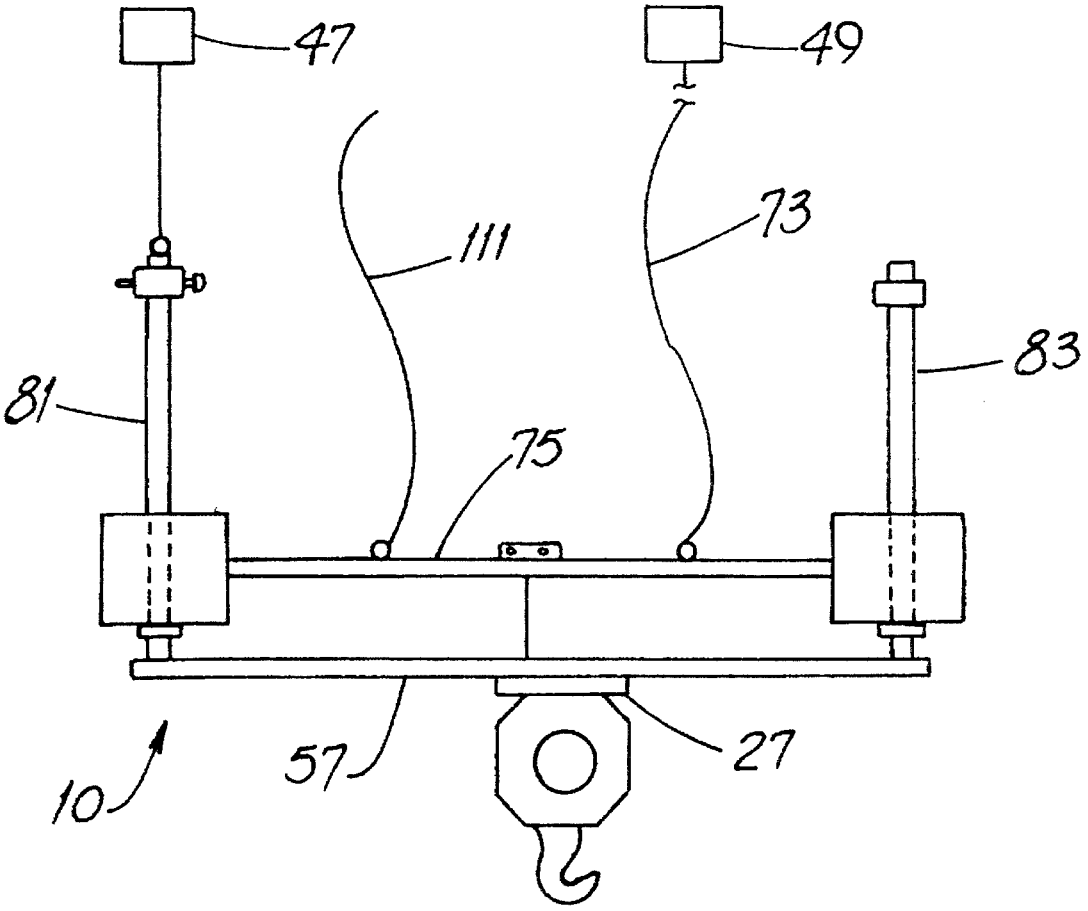

FIGS. 9, 10 and 11 are generally related to the depiction of FIG. 8. In FIG. 9, the bottom block 27 is shown to have contacted and lifted the first weight 57 above its repose position RFW to the position AFW. In normal operation, it would be expected that the control switch 47 would be actuated at about the illustrated position AFW of the first weight 57.

For purposes of description, however, it is assumed that the switch 47 was not actuated and as shown in FIG. 10, the first weight 57 has continued upward and the abutment devices 85 have contacted the second weight 75 at the locations 87, 89. In FIG. 11, both of the weights 57, 75 have been lifted upward by the bottom block 27 to the position ASW and the limit switch 49 is tripped as represented by the slack cable 73. Lifting of the second weight 75 is represented by the slack weight support chain 11 extending between the second weight 75 and an anchor point 113 on the crane 11.

Figure 12:
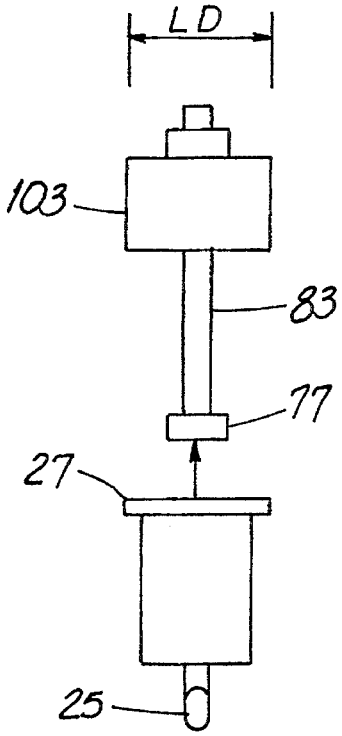
FIG. 12 is an end elevation view of the arrangement of FIG. 8 taken generally along the viewing plane 12—12 thereof.

Referring next to FIG. 12, a reason that the new dual weight assembly 10 is particularly useful in certain installations is now apparent. The maximum lateral dimension LD is substantially less than the lateral dimension needed in an arrangement having two separate laterally-spaced weights.

Figure 13:
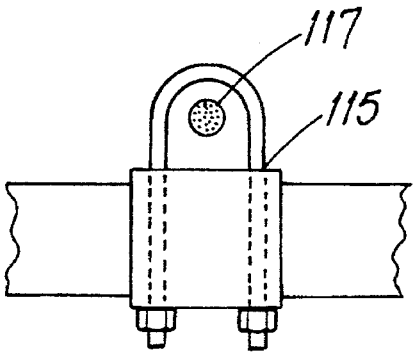
FIG. 13 is a top plan view of the cable guide taken generally along the viewing plane 13—13 of FIG. 5.

And that is not all. As noted above, the bottom block 21 may tend to swing from side to side under certain load-handling situations. As shown in FIGS. 5 and 13, the new dual weight assembly 10 preferably includes an "eye-like" cable guide 115 attached to the portion 79 of the second weight 75. A non-running or "dead" cable 117 extends through such guide 115 to help prevent or at least reduce side-to-side swinging of the bottom block 27.

The new assembly 10 has been described in connection with a crane 11 having a control limit switch 47 and a power limit switch 49. However, it should be appreciated that the crane 11 may be equipped with two control limit switches 47 and no power limit switch 49.

While the principles of the invention are described in connection with a few specific embodiments, it is to be understood clearly that such embodiments are exemplary and not limiting.

What is claimed:

1. A dual weight assembly for an overhead crane having a bottom block and first and second switches to be maintained at first and second positions, respectively, and wherein (a) the first and second switches are mounted on the machine at a substantially constant elevation above a floor, and (b) the assembly comprises:

a first weight maintaining the first switch at the first position;

a second weight maintaining the second switch at the second position;

and wherein:

the bottom block is below the weights; and.

the first weight and the second weight are telescoped to one another, whereby if the bottom block lifts the first weight toward the second weight, alignment of the weights is assured.

2. The assembly of claim 1 wherein:

the first weight includes a bar-like member;

the second weight includes an aperture; and the bar-like member extends through the aperture.

3. The assembly of claim 2 wherein:

the aperture is a first aperture and the second weight also includes a second aperture;

the bar-like member is a first bar-like member and the first weight also includes a second bar-like member extending through the second aperture.

4. The assembly of claim 3 wherein:

the bar-like members are generally parallel to one another; and a cross-piece extends between the bar-like members.

5. The assembly of claim 1 wherein:

the first weight and the second weight each include a cross-piece; and the cross-pieces are generally vertically aligned with one another.

6. The assembly of claim 5 wherein:

the material handling machine is an overhead crane; and the bottom block and the cross-pieces are generally vertically aligned with one another.

7. The assembly of claim 1 wherein:

the first weight is mounted for movement between a repose position and a position actuating the first switch;

the first weight includes a bar-like member having a stop device mounted thereon; and in the repose position, the stop device is spaced from the second weight.

8. The assembly of claim 7 wherein:

the first weight also includes an abutment device mounted thereon; and in the position actuating the first switch, the abutment device is spaced from the second weight.

9. The assembly of claim 1 wherein:

the second switch is a power limit switch; and a cable extends between the second weight and the limit switch.

10. The assembly of claim 9 wherein:

the second weight includes at least one block-like portion; and an aperture extends through the block-like portion.

11. The assembly of claim 10 wherein the first weight includes a bar-like member extending through the aperture.

12. The assembly of claim 9 wherein:

the second weight includes at least one block-like portion;

a tube member is attached to the block-like portion; and the first weight includes a bar-like member extending through the tube member.

13. A dual weight assembly for a crane having a bottom block, the assembly comprising:

a first weight and a second weight;

and wherein:

the first weight is suspended from a first pair of cables;

the second weight is suspended from a second pair of cables;

when the first weight is lifted by the bottom block, the first weight contacts the second weight at two spaced-apart locations, whereby the second weight is lifted by upward travel of the bottom block and the first weight.

14. The assembly of claim 13 wherein (a) the first pair of cables passes through the second weight, and (b) the first and second weights each have generally horizontally elongate portions which are generally parallel to one another.

15. A dual weight assembly for a material handling machine having first and second switches to be maintained at first and second positions, respectively, the assembly comprising:

a first weight maintaining the first switch at the first position;

a second weight maintaining the second switch at the second position;

the first weight and the second weight are telescoped to one another, and wherein:

the first weight is mounted for movement between a repose position and a position actuating the first switch;

the first weight includes a bar-like member having a stop device mounted thereon; and in the repose position, the stop device is spaced from the second weight.

16. The assembly of claim 15 wherein:

the first weight also includes an abutment device mounted thereon; and in the position actuating the first switch, the abutment device is spaced from the second weight.

17. A dual weight assembly for a material handling machine having first and second switches to be maintained at first and second positions, respectively, the assembly comprising:

a first weight maintaining the first switch at the first position;

a second weight maintaining the second switch at the second position; and the first weight and the second weight are telescoped to one another, and wherein:

the second switch is a power limit switch; and a cable extends between the second weight and the limit switch.

18. The assembly of claim 17 wherein:

the second weight includes at least one block-like portion; and an aperture extends through the block-like portion.

19. The assembly of claim 18 wherein the first weight includes a bar-like member extending through the aperture.

20. The assembly of claim 17 wherein:

the second weight includes at least one block-like portion;

a tube member is attached to the block-like portion; and the first weight includes a bar-like member extending through the tube member.

* * * * *